US008109743B2

(12) United States Patent
Yoshida et al.

(10) Patent No.: US 8,109,743 B2
(45) Date of Patent: Feb. 7, 2012

(54) AXIAL FLOW FAN UNIT

(75) Inventors: Yusuke Yoshida, Kyoto (JP); Shinya Kaneoya, Kyoto (JP)

(73) Assignee: Nidec Corporation, Kyoto (JP)

( * ) Notice: Subject to any disclaimer, the term of this patent is extended or adjusted under 35 U.S.C. 154(b) by 622 days.

(21) Appl. No.: 12/328,848

(22) Filed: Dec. 5, 2008

(65) Prior Publication Data

US 2009/0148311 A1 Jun. 11, 2009

(30) Foreign Application Priority Data

Dec. 11, 2007 (JP) ..... 2007-319472

(51) Int. Cl.
*F04B 35/04* (2006.01)

(52) U.S. Cl. ..... 417/423.14; 417/244; 417/356

(58) Field of Classification Search ..... 417/244, 417/356, 423.4, 423.14
See application file for complete search history.

(56) References Cited

U.S. PATENT DOCUMENTS 6,827,549 B1 12/2004 Horng et al.
7,156,611 B2 1/2007 Oosawa et al.
2007/0134091 A1 6/2007 Chu et al.
2007/0274821 A1* 11/2007 Yoshida ..... 415/68
2008/0138191 A1* 6/2008 Chang et al. ..... 415/98
2008/0286135 A1* 11/2008 Yoshida et al. ..... 417/423.5
2009/0022587 A1* 1/2009 Yoshida et al. ..... 415/213.1

FOREIGN PATENT DOCUMENTS

CN 101082343 A 12/2007
JP 2004-278371 A 10/2004

* cited by examiner

*Primary Examiner* — Toan Ton
*Assistant Examiner* — Kevin Quarterman
(74) *Attorney, Agent, or Firm* — Keating & Bennett, LLP

(57) ABSTRACT

An axial flow fan unit includes a first and a second axial flow fan. The first axial flow fan includes a first motor, a plurality of first lead lines connected to the first motor, a first impeller rotatable about a center axis by the first motor, and a first housing arranged to enclose the first motor and the first impeller, wherein the first housing has a first recess portion extending from an inside to an outside of the first housing. Likewise, the second axial flow fan includes a second motor, a plurality of second lead lines, a second impeller, and the second housing, wherein the second housing has a second recess portion extending from an inside to an outside of the second housing. The first and the second lead lines are led out from the first and the second housings through the first and the second recesses, respectively. Further, the first recess portion is deviated relative to or partially overlapped with the second recess portion along a circumferential direction.

16 Claims, 12 Drawing Sheets

A — A

AXIAL FLOW FAN UNIT

BACKGROUND OF THE INVENTION

1. Field of the Invention

The present invention relates to an axial flow fan unit including a plurality of axial flow fans connected in series.

2. Description of the Related Art

Conventionally, a cooling fan is installed inside a housing of various kinds of electronic devices to cool electronic parts thereof. As the electronic parts enjoy high performance and suffer from increased heat generation, there is a need to increase the static pressure and flow rate of the cooling fan. To meet this need, a serially arranged axial flow fan unit with a plurality of axial flow fans connected in series is used in recent years as a cooling fan that can secure a great enough static pressure and an increased flow rate.

The serially arranged axial flow fan unit includes a plurality of housings within which a plurality of motors are arranged. A plurality of lead lines is led from the motors to the outside of the housings through recess portions for lead line guidance provided on the side portions of the housings.

If the lead lines are not orderly led out of the housings, however, there is a fear that the lead lines are pushed out when mounting the serially arranged axial flow fan unit to the electronic devices or the like and are damaged or severed by physical interference with other parts. Inside the housings, the lead lines may be flexed to thereby impede airflow and increase noises attributable thereto. For the reasons noted above, the method of conducting the lead lines is of great importance in the serially arranged axial flow fan unit.

SUMMARY OF THE INVENTION

In order to overcome the problems described above, preferred embodiments of the present invention provide a serially arranged axial flow fan unit including a first axial flow fan and a second axial flow fan. The first and the second axial flow fans each preferably have a first motor and a second motor; a first impeller and a second impeller rotatable about a center axis by the first and the second motor; and a first housing and a second housing that are hollow to accommodate the first and the second motor and the first and the second impeller, respectively. In the first and the second housing, a first recess portion and a second recess portion are provided, respectively, wherein an inside and outside of the first and the second housings are joined at the first and the second recess portions, respectively. The first and the second recess portions are arranged in the circumferential direction about the center axis. The first lead lines and the second lead lines connected to the first and the second motors, respectively, extend to the outside of the first and the second housings via the first and the second recess portions. Thus, it is possible to guide the first and the second lead lines on the first and the second housings.

Further, at least one guide portion is provided on the first and the second housings to guide the first and the second lead lines therethrough. Thus, it is possible to guide the first and the second lead lines in a desired direction depending on the installed location of the axial flow fan unit.

Further, by provided an end portion hook and a guide portion hook in the guide portion, it is possible to guide the first and the second lead lines on the first and the second housings more reliably.

Furthermore, at least one of the first and the second recess portions has a first gap extending in the axial direction and a second gap extending from the first gap in the circumferential direction. By guiding the first and the second lead lines via the first and the second gaps, it is possible to prevent the lead lines from being bent.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
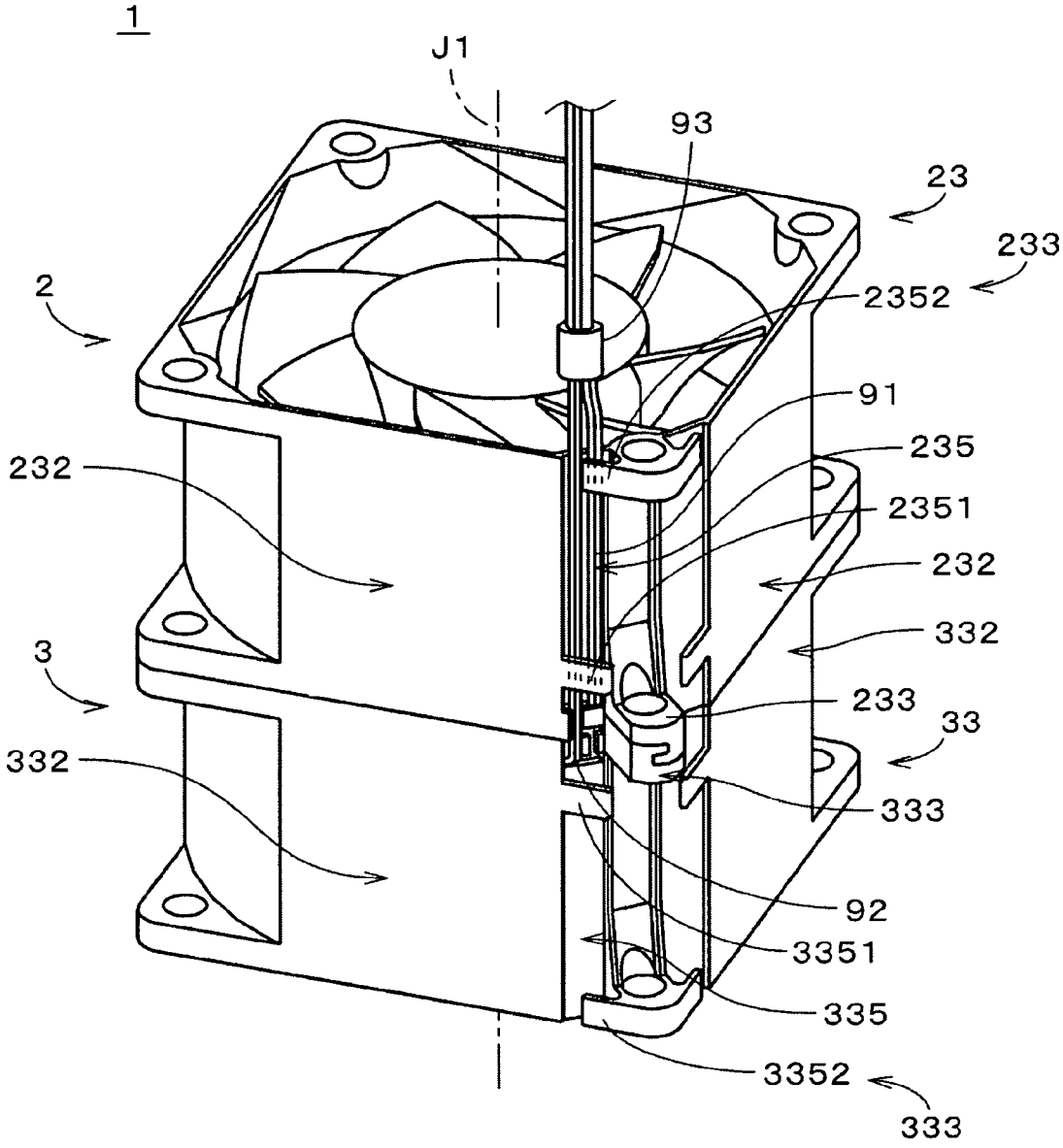
FIG. 1 is a perspective view showing a serially arranged axial flow fan unit in accordance with a first preferred embodiment of the present invention.

Referring to FIGS. 1 through 12, preferred embodiments of the present invention will be described in detail. It should be noted that in the explanation of the preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. In the following description, an axial direction indicates a direction parallel or substantially parallel to a rotation axis, and a radial direction indicates a direction perpendicular or substantially perpendicular to the rotation axis.

FIG. 1 is a perspective view showing a serially arranged axial flow fan unit 1 in accordance with a first preferred embodiment of the present invention. The axial flow fan unit 1 is a contra-rotating axial flow fan and includes a first axial flow fan 2 and a second axial flow fan 3 arranged along the center axis J1 of the first axial flow fan 2. In the present preferred embodiment, the center axis J1 of the first axial flow fan 2 coincides with the center axis of the second axial flow fan 3.

Air is drawn from the upper side of the first axial flow fan 2 and exhausted to the lower side of the second axial flow fan 3. That is, an air stream moving along the center axis J1 is generated in the axial flow fan unit 1. Thus, a sufficient air volume is achieved and a static pressure is increased in the axial flow fan unit 1.

The first axial flow fan 2 is provided with a plurality of first lead lines 91 and the second axial flow fan 3 is provided with a plurality of second lead lines 92, the lead lines 91 and 92 being used to supply electric power. The first lead lines 91 are conducted to the outside from the lower end of a first housing 23 of the first axial flow fan 2 and are guided upwardly along a guide portion 235 on the first housing 23 in a substantially parallel relationship with the center axis J1. Similarly, the second lead lines 92 are conducted to the outside from the upper end of a second housing 33 of the second axial flow fan 3 and are guided upwardly on the first housing 23 together with the first lead lines 91 in a substantially parallel relationship with the center axis J1. A guide portion hook 2351 is provided on the outer surface of the first housing 23 and an end portion hook 2352 is provided at the end portion of the first housing 23. The first lead lines 91 and the second lead lines 92 are held in place by the guide portion hook 2351 and the end portion hook 2352 against removal from the outer surface of the first housing 23. Above the first housing 23, the first lead lines 91 and the second lead lines 92 are preferably tied together by a tying member 93. The first lead lines 91 and the second lead lines 92 are connected to an external power source (not shown).

Figure 2:
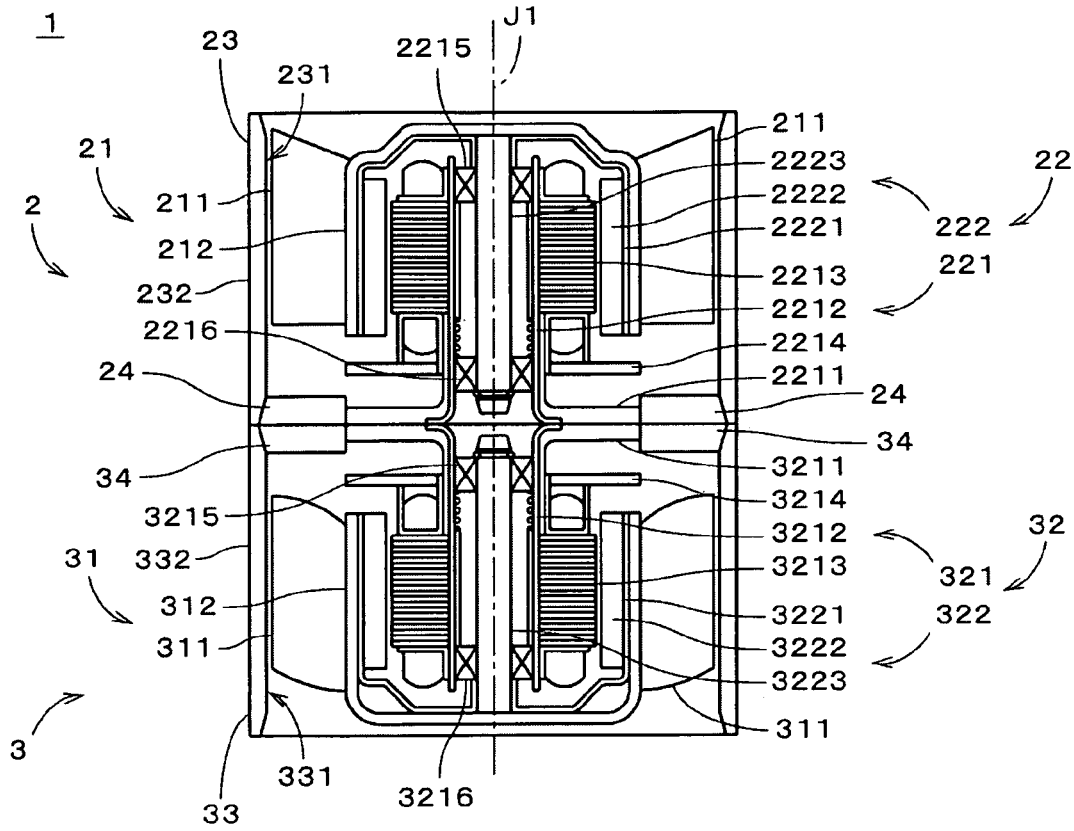
FIG. 2 is a vertical section view of the axial flow fan unit in accordance with the first preferred embodiment of the present invention.

FIG. 2 is a sectional view of the axial flow fan unit 1 in accordance with the first preferred embodiment of the present invention, which view is taken along a plane containing the center axis J1. The axial flow fan unit 1 includes a first motor 22. The first motor 22 is supported by a plurality of (four in the present preferred embodiment, for example) first support ribs 24 and is designed to rotate a first impeller 21 about the center axis J1. The first housing 23 is a hollow member. The first impeller 21, the first motor 22, and the first support ribs 24 are arranged within the first housing 23. The first support ribs 24 extend from the outer surface of a first base portion 2211 of the first motor 22 toward an inner surface 231 of the first housing 23 and are arranged along a circumferential direction so that they interconnect the first base portion 2211 and the first housing 23 (see FIG. 3). The first impeller 21 is rotatably driven by the first motor 22 to thereby generate an air stream flowing in the direction parallel to the center axis J1.

The first impeller 21 has a cup 212, i.e., a generally cylindrical closed-top member, arranged to cover the outer surface of the first motor 22. The first impeller 21 has a plurality of (seven in the present preferred embodiment, for example) first blades 211 extending radially outward from the outer surface of the cup 212 with respect to the center axis J1 and arranged at an equal pitch along the circumferential direction. The cup 212 and the first blades 211 are preferably a single member formed by injection-molding a resin material, for example.

The first motor 22 includes a first stator portion 221 and a first rotor portion 222 positioned axially above the first stator portion 221. The first rotor portion 222 is provided with a yoke 2221, a field magnet 2222, and a shaft 2223. The yoke 2221 is preferably made of a metal to define a magnetic body and has a generally cylindrical closed-top shape around the center axis J1. The field magnet 2222 has a substantially cylindrical shape and is fixedly secured to the inner surface of the yoke 2221. The shaft 2223 is fixed at one end to the upper central portion of the yoke 2221. Since the yoke 2221 is covered by the cup 212, the first rotor portion 222 and the first impeller 21 define an integrally united member.

The first stator portion 221 is provided with the first base portion 2211, a bearing holder portion 2212, an armature 2213, and a circuit board 2214. The first base portion 2211 preferably is a substantially disk-shaped member and is arranged adjacent to the second axial flow fan 3. The bearing holder portion 2212 is a substantially cylindrical member and is arranged in the central portion of the first base portion 2211 so that it can protrude upwardly. The armature 2213 is attached to the outer circumferential surface of the bearing holder portion 2212. The circuit board 2214 having a substantially annular plate shape is arranged below the armature 2213 and is electrically connected to the armature 2213. The circuit board 2214 is electrically connected to the first lead lines 91 so that an electric current from the external power source and a control signal can be supplied to the circuit board 2214 through the first lead lines 91. The armature 2213 is radially opposite to the field magnet 2222 and is supplied with a driving current from the external power source through the circuit board 2214. In response, the torque acting about the center axis J1 is generated between the armature 2213 and the field magnet 2222. Ball bearings 2215 and 2216 are arranged in the upper and lower portions within the bearing holder portion 2212 along the center axis J1 to rotatably support the shaft 2223.

The second axial flow fan 3 has a structure obtained by vertically inverting the first axial flow fan 2. The second axial flow fan 3 includes a second motor 32 arranged to rotate a second impeller 31 about the center axis J1. The second axial flow fan 3 further includes the second housing 33 which is a hollow member arranged to enclose the second motor 32 and the outer circumferential surface of the second impeller 31. Inside the second housing 33, there are arranged second support ribs 34 whose number is the same as that of the first support ribs 24 (i.e., four). The second support ribs 34 extend from the outer surface of a second base portion 3211 of the second motor 32 toward an inner surface 331 of the second housing 33 and are arranged along a circumferential direction so that they interconnect the second base portion 3211 and the second housing 33 (see FIG. 6). In the axial flow fan unit 1, the first impeller 21, the first support ribs 24, the second support ribs 34, and the second impeller 31 are arranged in this order from the upper side to the lower side in an end-to-end relationship with one another.

The second impeller 31 includes a cup 312 arranged to cover the outer surface of a yoke 3221 and a plurality of (five in the present preferred embodiment, for example) second blades 311. The second blades 311 extend radially outward from the outer surface of the cup 312 with respect to the center axis J1 and are arranged at an equal pitch along the circumferential direction. The cup 312 and the first blades 311 are preferably a single member formed by injection-molding a resin material, for example. In the present preferred embodiment, the direction of rotation of the second impeller 31 is opposite to that of the first impeller 21. An air stream flowing in the same direction as the air stream generated by the rotation of the first impeller 21 is generated by the rotation of the second impeller 31. The air stream thus generated is discharged to the outside. As a result, the air stream generated by the axial flow fan unit 1 has an increased static pressure and an increased volume.

The second motor 3 has substantially the same structure as the first motor 22, except that second motor 32 is a vertical inversion of the first motor 22. In the second motor 32, a second stator portion 321 is positioned above a second rotor portion 322. The second rotor portion 322 is provided with the yoke 3221, a field magnet 3222, and a shaft 3223. The yoke 3221 is preferably made of a metal to define a magnetic body and has a generally cylindrical closed-top shape around the center axis J1. The field magnet 3222 has a substantially cylindrical shape and is fixedly secured to the inner surface of the yoke 3221. The shaft 3223 is arranged at the center of the yoke 3221 so as to protrude upwardly.

The second stator portion 321 is provided with the second base portion 3211 having a substantially disk-shaped shape, a bearing holder portion 3212, and ball bearings 3215 and 3216. The bearing holder portion 3212 has a substantially cylindrical shape and protrudes downwardly from the center of the second base portion 3211. The ball bearings 3215 and 3216 are received within the bearing holder portion 3212 and held in the upper and lower portions of the bearing holder portion 3212. An armature 3213 is attached to the outer circumferential surface of the bearing holder portion 3212. A circuit board 3214 is arranged above the armature 3213 and is connected to the external power source through the second lead lines 92. The second base portion 3211 is axially opposite to the first base portion 2211. The armature 3213 is radially opposite to the field magnet 3222 and is supplied with a driving current and a control signal through the circuit board 3214. In response, the torque acting about the center axis J1 is generated between the armature 3213 and the field magnet 3222.

In the present preferred embodiment, as shown in FIGS. 1 and 2, the first housing 23 has an outer side surface 232 extending substantially in a vertical direction between the substantially rectangular upper and lower surfaces. The first housing 23 defined by the outer side surface and the upper and lower surfaces has a substantially quadrangular prism-shaped contour. Similarly, the second housing 33 has an outer side surface 332 extending substantially in a vertical direction between the substantially rectangular upper and lower surfaces. The second housing 33 defined by the outer side surface and the upper and lower surfaces has a substantially quadrangular prism-shaped contour such that the four corner portions of the second housing 33 overlap with those of the first housing 23.

Figure 3:
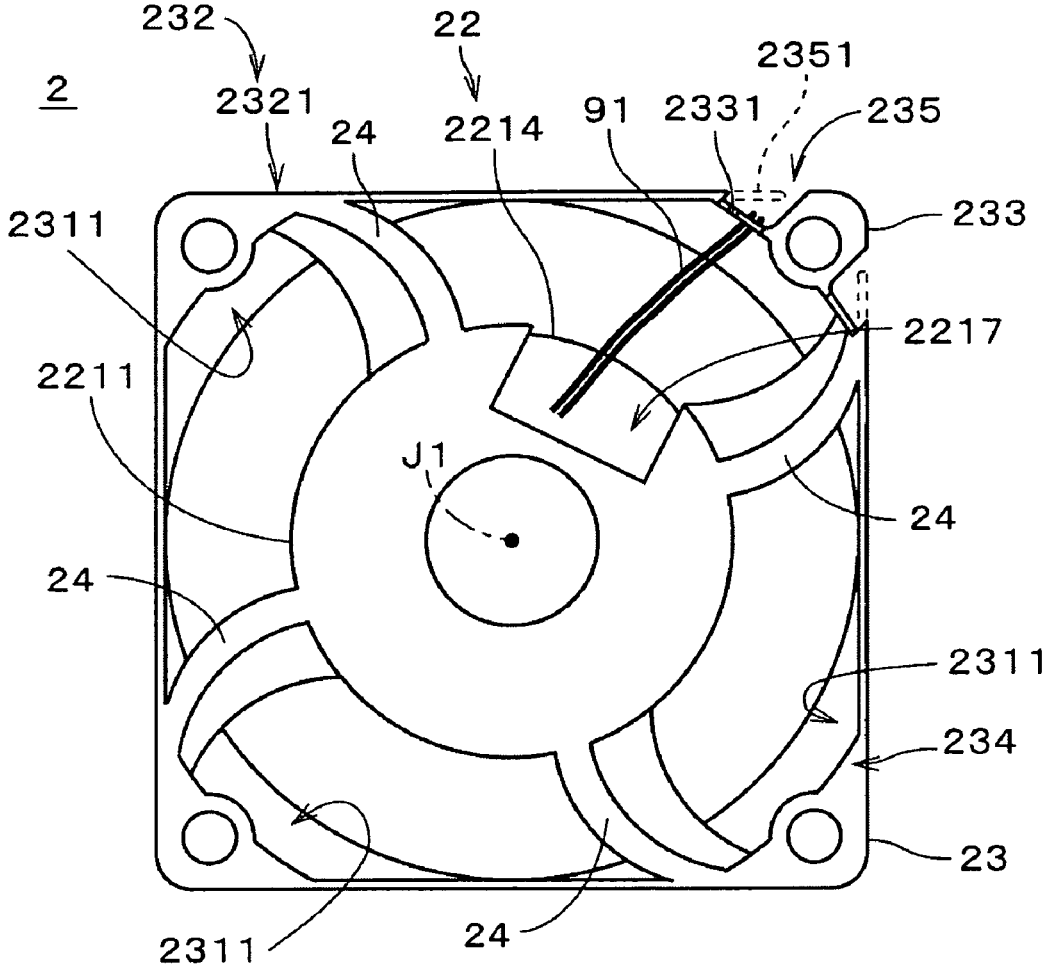
FIG. 3 is a bottom view showing a first axial flow fan in the first preferred embodiment of the present invention.

FIG. 3 is a bottom view of the first axial flow fan 2 as seen from the exhaust side. In FIG. 3, the first impeller 21 is omitted to show a portion of the first lead lines 91. As shown in FIG. 3, the end portion 2321 of the first housing 23 adjacent to the second housing 33 has a substantially square shape. Slanting surfaces 2311 extending gradually away from the center axis J1 toward a lower surface 234 (the end surface of the end portion 2321) are provided in the four corner portions on the inner surface of the end portion 2321 (namely, the lower region of the inner surface 231 of the first housing 23 shown in FIG. 2).

The cross-section of each of the first support ribs 24 taken along a plane perpendicular to the center axis J1 has a substantially arc-shaped blade shape. The cross-section of each of the first support ribs 24 is not particularly limited but may be, e.g., a substantially flat shape. The first base portion 2211 has a cutout 2217 opposite to the guide portion 235 arranged to guide the first lead lines 91 and the second lead lines 92. The first lead lines 91 are conducted from the lower surface of the circuit board 2214 toward the guide portion 235 through the cutout 2217.

As shown in FIGS. 1 and 3, the guide portion 235 of the first housing 23 is provided near one side of the first housing 23, which side is substantially parallel to the center axis J1. The guide portion 235 has a groove-shaped recess and extends from the lower end of the first housing 23 to the upper end thereof along the outer side surface. Four flange portions having fastener holes in the four corner portions are respectively provided in the upper and lower end portions of the first housing 23. Two of the four flange portions overlap with the guide portion 235 (these two flange portions will be referred to as "guide flange portions 233" hereinbelow). As shown in FIG. 3, a first recess portion 2331 is provided in one corner portion of the end portion 2321 of the guide portion 235 adjacent to the second housing 33 (namely, in the vicinity of the lower guide flange portion 233). The first recess portion 2331 extends upwardly from the lower surface 234 and is continuous from the radial inner side of the first housing 23 to the radial outer side thereof.

Referring again to FIG. 1, the guide portion 235 has the guide portion hook 2351 and the end portion hook 2352. As indicated by a broken line in FIG. 3, the guide portion hook 2351 is a substantially flat restraint portion and extends substantially in a horizontal direction along the substantially quadrangular prism-shaped contour of the first housing 23 from the outer side surface 232 toward the corner of the contour. In the vicinity of the first recess portion 2331 (namely, in the vicinity of the lower guide flange 233 shown in FIG. 1), the guide portion hook 2351 serves to keep the first lead lines 91 and the second lead lines 92 from moving outward. Consequently, the first lead lines 91 and the second lead lines 92 are prevented from being pushed out beyond the contour of the first housing 23 in the vicinity of the first recess portion 2331. As shown in FIG. 1, the end portion hook 2352 has a substantially flat restraint portion and extends substantially in a horizontal direction along the substantially quadrangular prism-shaped contour of the first housing 23 from the guide flange 233 toward the adjacent flange portion.

Figure 4:
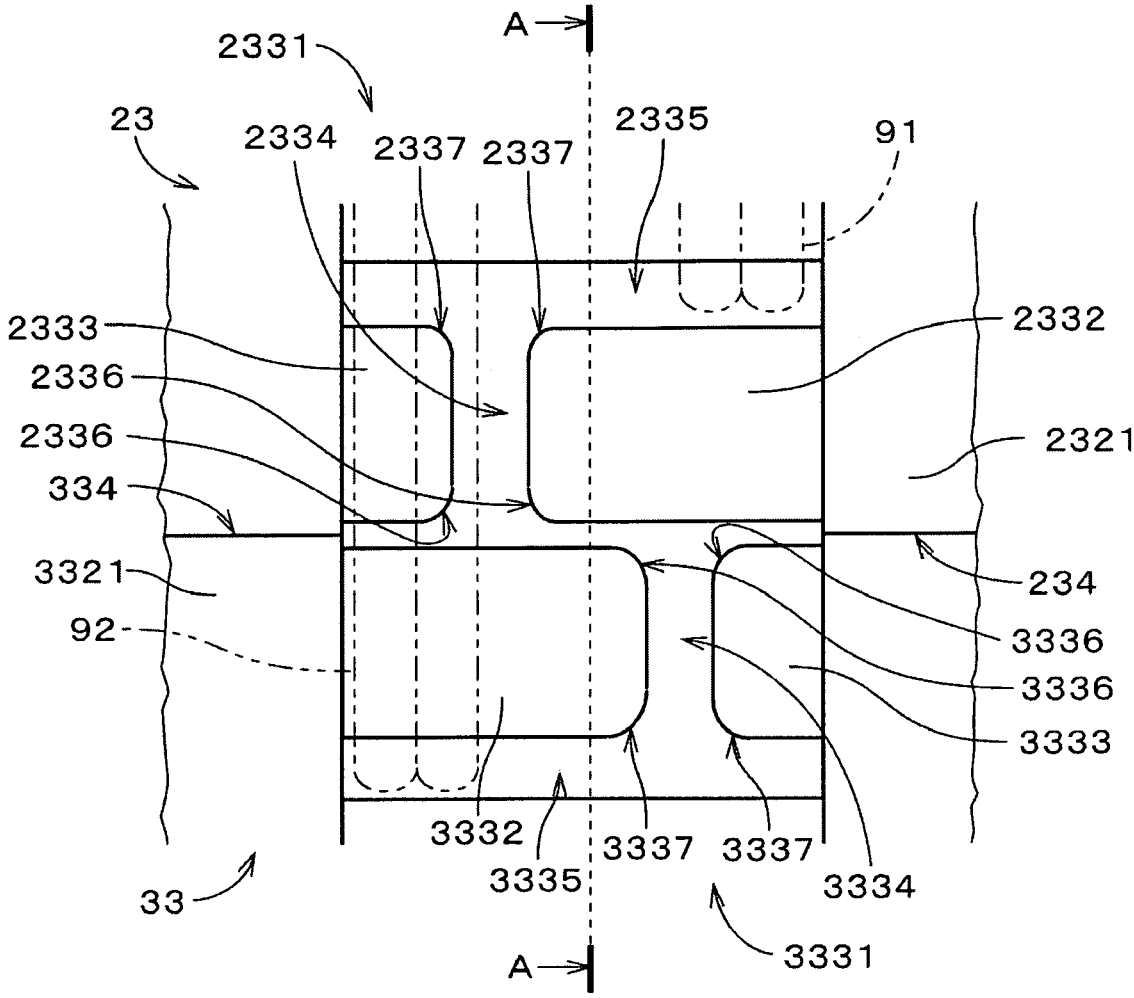
FIG. 4 is an enlarged view showing a recess portion and its vicinity in the first preferred embodiment of the present invention.

FIG. 4 is an enlarged view of the first recess portion 2331, the below-mentioned second recess portion 3331 and their vicinity as seen from the outer side of the guide flange 233 of the axial flow fan unit 1 toward the center axis J1 in FIG. 1. The first lead lines 91 and the second lead lines 92 are indicated by double-dotted chain lines.

In the position of the end portion 2321 where the first recess portion 2331 is provided, there are provided a first hook 2332 protruding from the right to the left in FIG. 4 and a second hook 2333 protruding from the left to the right. The lower edges of the first hook 2332 and the second hook 2333 can be regarded as defining a portion of the lower surface 234, i.e., the end surface, of the first housing 23. A first gap 2334 is defined between the tip end of the first hook 2332 and the tip end of the second hook 2333 and extends substantially parallel to the center axis J1 from the lower surface 234. A second gap 2335 is defined between the upper edges of the first hook 2332 and the second hook 2333 and the portion of the first housing 23 opposite to the upper edges, and extends circumferentially about the center axis J1 from the upper end of the first gap 2334.

The first recess portion 2331 is opposite to the second housing 33 and has a generally T-shaped shape defined by the combination of the first gap 2334 and the second gap 2335. The first hook 2332 has a circumferential length greater than that of the second hook 2333. The position of the first gap 2334 is offset to the left from the center between the fixed ends of the first hook 2332 and the second hook 2333. Each of the first gap 2334 and the second gap 2335 has a width greater than that of the first lead lines 91. The first lead lines 91 are led from the first motor 22 (see FIG. 2) and are conducted to the outside through the second gap 2335 of the first recess portion 2331.

Figure 5:
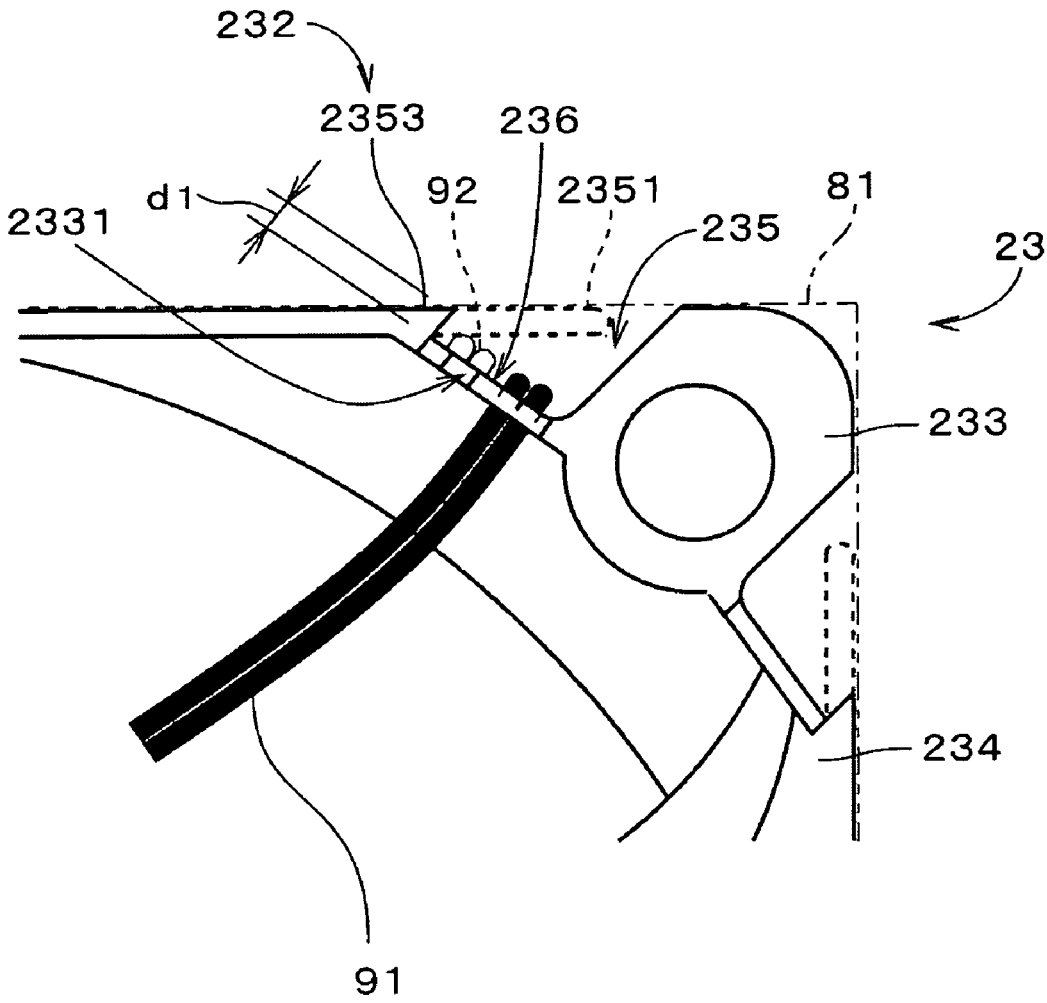
FIG. 5 is an enlarged view showing a guide portion and its vicinity in the first preferred embodiment of the present invention.

FIG. 5 is an enlarged view showing the guide portion 235 and its vicinity in the lower surface 234 of the first housing 23.

In FIG. 5, the contour of the first housing 23 is indicated by a double-dotted chain line 81 and the guide portion hook 2351 is indicated by a broken line. The guide portion 235 is in the shape of a groove extending substantially parallel to the center axis J1. As shown in FIGS. 1 and 5, the first lead lines 91 and the second lead lines 92 are guided substantially parallel to the center axis J1 from the first recess portion 2331 toward the inner side of the substantially quadrangular prism-shaped contour 81. As can be seen in FIG. 5, the guide portion 235 extends to the upper and lower end surfaces of the first housing 23 through the guide flange portions 233. The first recess portion 2331 is positioned in the guide portion bottom surface 236 of the guide portion 235. In other words, the surface of the first housing 23 (namely, the guide portion bottom surface 236) is positioned inward of the contour 81 of the first housing 23 in the vicinity of the first recess portion 2331.

A protrusion portion 2353 protruding from the guide portion bottom surface 236 is provided in the end portion of the outer side surface 232 adjacent to the guide portion 235. Therefore, in the vicinity of the lower end portion of the guide portion 235, the movement of the first lead lines 91 and the second lead lines 92 in the substantially horizontal direction is restrained by the guide flange portion 233, the protrusion portion 2353, and the guide portion hook 2351.

In the guide portion 235, the minimum value of the distance between the guide portion bottom surface 236 and the contour 81 of the first housing 23 (namely, the distance d1 measured from the tip end of the protrusion portion 2353 to the guide portion bottom surface 236 in FIG. 5) is equal to or greater than the diameter of the first lead lines 91 and the second lead lines 92. Therefore, the first lead lines 91 and the second lead lines 92 are received within the guide portion 235 and are prevented from being pushed out beyond the contour of the first housing 23. As a consequence, the first lead lines 91 and the second lead lines 92 are held against physical interference with other parts when the axial flow fan unit 1 is mounted in its installation position (e.g., within a housing of an electronic device). It is often the case that the first lead lines 91 are most severely flexed in the vicinity of the first recess portion 2331. In view of this, the guide portion 235 may have a depth greater than the diameter of the first lead lines 91 only in the vicinity of the first recess portion 2331.

Figure 6:
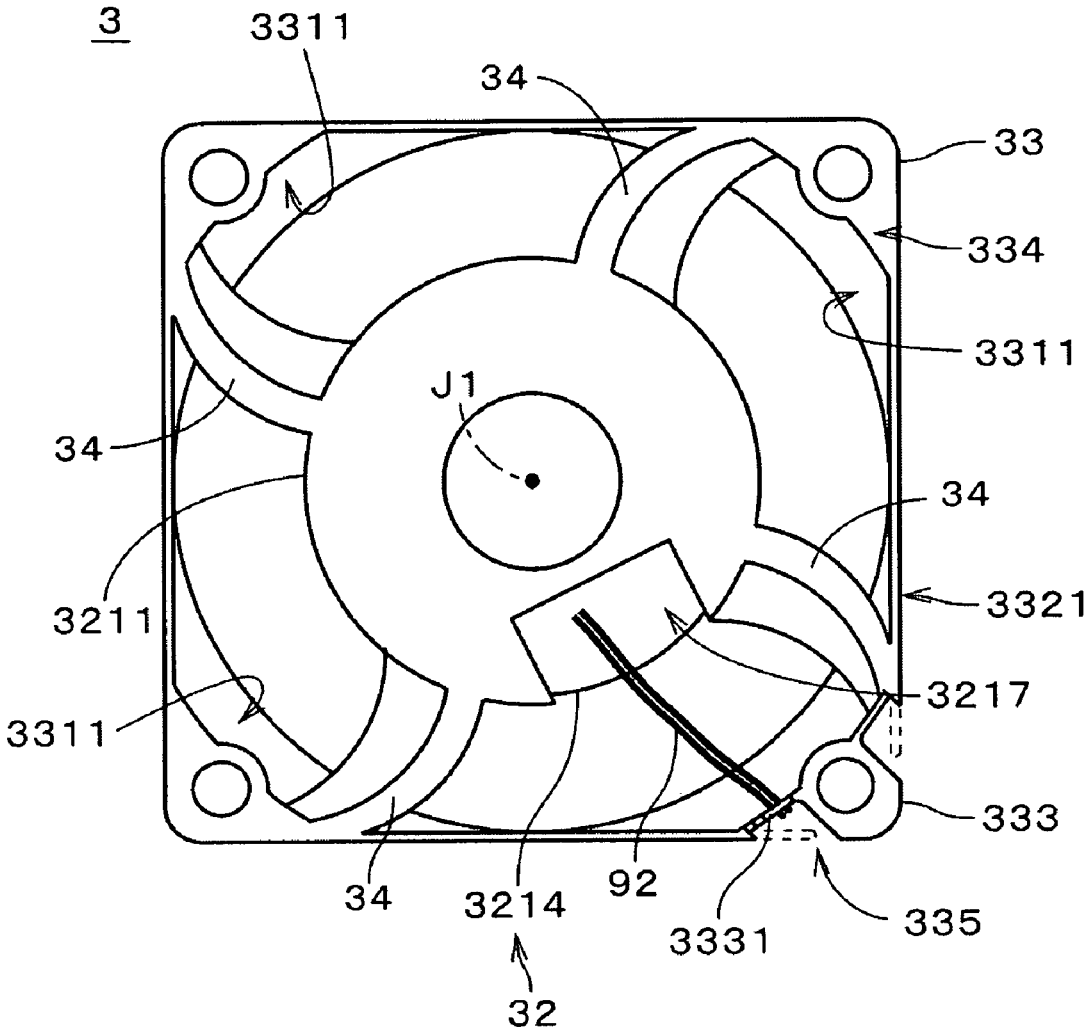
FIG. 6 is a plan view showing a second axial flow fan in the first preferred embodiment of the present invention.

FIG. 6 is a plan view of the second axial flow fan 3 as seen from the intake side. In FIG. 6, the second impeller 31 is omitted to show a portion of the second lead lines 92. Referring to FIGS. 1 and 6, the second housing 33 has a shape substantially symmetrical with the first housing 23 in the up-and-down direction. The end portion 3321 of the second housing 33 adjacent to the first housing 23 has a substantially square shape. Slanting surfaces 3311 extending gradually away from the center axis J1 toward the upper surface 334 of the end portion 3321 (the end surface of the end portion 3321) are provided in the four corner portions on the inner surface of the end portion 3321 (namely, the upper region of the inner surface 331 of the second housing 33 shown in FIG. 2).

The cross-section of each of the second support ribs 34 taken along a plane perpendicular to the center axis J1 has a substantially arc-shaped blade shape. The cross-section of each of the second support ribs 34 is not particularly limited but may be, e.g., a substantially flat shape. The substantially disk-shaped second base portion 3211 is held in place by the second support ribs 34 and has a cutout 3217 radially opposite a guide portion 335 of the second housing 33 positioned just below the guide portion 235 (see FIG. 3). The second lead lines 92 are conducted from the lower surface of the circuit board 3214 toward the guide portion 335 through the cutout 3217.

As shown in FIGS. 1 and 6, the guide portion 335 is provided near one side of the substantially quadrangular prism-shaped contour of the second housing 33, which is substantially parallel to the center axis J1. The guide portion 335 includes a groove-shaped recess that defines an extension of the guide portion 235 and extends from the lower end of the second housing 33 to the upper end thereof along the outer side surface. Four flange portions having fastener holes provided in the four corner portions are respectively provided in the upper and lower end portions of the second housing 33. Two of the four flange portions overlap with the guide portion 335 (the two flange portions will be referred to as "guide flange portions 333" hereinbelow). A second recess portion 3331 extending downwardly from the upper surface 334 and continuously extending from the inner side of the second housing 33 to the outer side thereof is provided in the corner portion near the guide flange portions 333 (namely, in the corner portion overlapped with the corner portion in which the first recess portion 2331 of the first housing 23 is provided). The second lead lines 92 pass through the second recess portion 3331.

As illustrated in FIG. 4, in the position where the second recess portion 3331 is provided, there are provided a first hook 3332 protruding from the left to the right and a second hook 3333 protruding from the right to the left. As in case of the first recess portion 2331, a first gap 3334 extending substantially parallel to the center axis J1 from the upper surface 334, i.e., the end surface, of the second housing 33 is defined between the first hook 3332 and the second hook 3333. A second gap 3335 extending circumferentially about the center axis J1 from the lower end of the first gap 3334 is provided along the lower edges of the first hook 3332 and the second hook 3333. The second recess portion 3331 is opposite to the first housing 23 and has a generally T-shaped shape by the combination of the first gap 3334 and the second gap 3335.

The circumferential position of the first gap 3334 is offset to the right from the center between the fixed ends of the first hook 3332 and the second hook 3333. Therefore, the first gap 2334 of the first recess portion 2331 and the first gap 3334 of the second recess portion 3331 are arranged in the circumferential direction substantially in parallel to each other such that the first gap 2334 of the first recess portion 2331 is deviated relative to or partially overlapped with the first gap 3334 of the second recess portion 3331 along the circumferential direction. In other words, the first gap 2334 of the first recess portion 2331 is substantially in parallel with the first gap 3334 of the second recess portion 3331 such that the first gap 2334 does not face or partially faces the first gap 3334 in the axial direction. The first gap 3334 and the second gap 3335 have a width greater than that of the second lead lines 92. The second lead lines 92 are conducted to the outside from the second motor 32 (see FIG. 2) through the second gap 3335.

In the present preferred embodiment, as shown in FIG. 1, the first lead lines 91 and the second lead lines 92 are conducted upwardly in FIG. 1 by the guide portion 235. Thus, the guide portion 335 is not in use. However, since the guide portion 335 provides a space arranged to guide the first lead lines 91 and the second lead lines 92 substantially parallel to the center axis J1 from the first recess portion 2331 and the second recess portion 3331 within the quadrangular prism-shaped contour 82, it is also possible to downwardly guide the first lead lines 91 and the second lead lines 92 in FIG. 1. In other words, since the first housing 23 and the second housing 33 are respectively provided with the guide portion 235 and the guide portion 335, the first lead lines 91 and the second lead lines 92 can be guided toward either the first housing 23 or the second housing 33 depending on the location in which the axial flow fan unit 1 is installed.

As shown in FIG. 1, a guide portion hook 3351 and an end portion hook 3352 are provided in the guide portion 335. The guide portion hook 3351 and the end portion hook 3352 are restraint portions that prevent the first lead lines 91 and the second lead lines 92 from moving outward in the vicinity of the second recess portion 3331. Consequently, when downwardly guiding the first lead lines 91 and the second lead lines 92, the first lead lines 91 and the second lead lines 92 are prevented from being pushed out beyond the contour of the second housing 33 in the vicinity of the second recess portion 3331.

Figure 7:
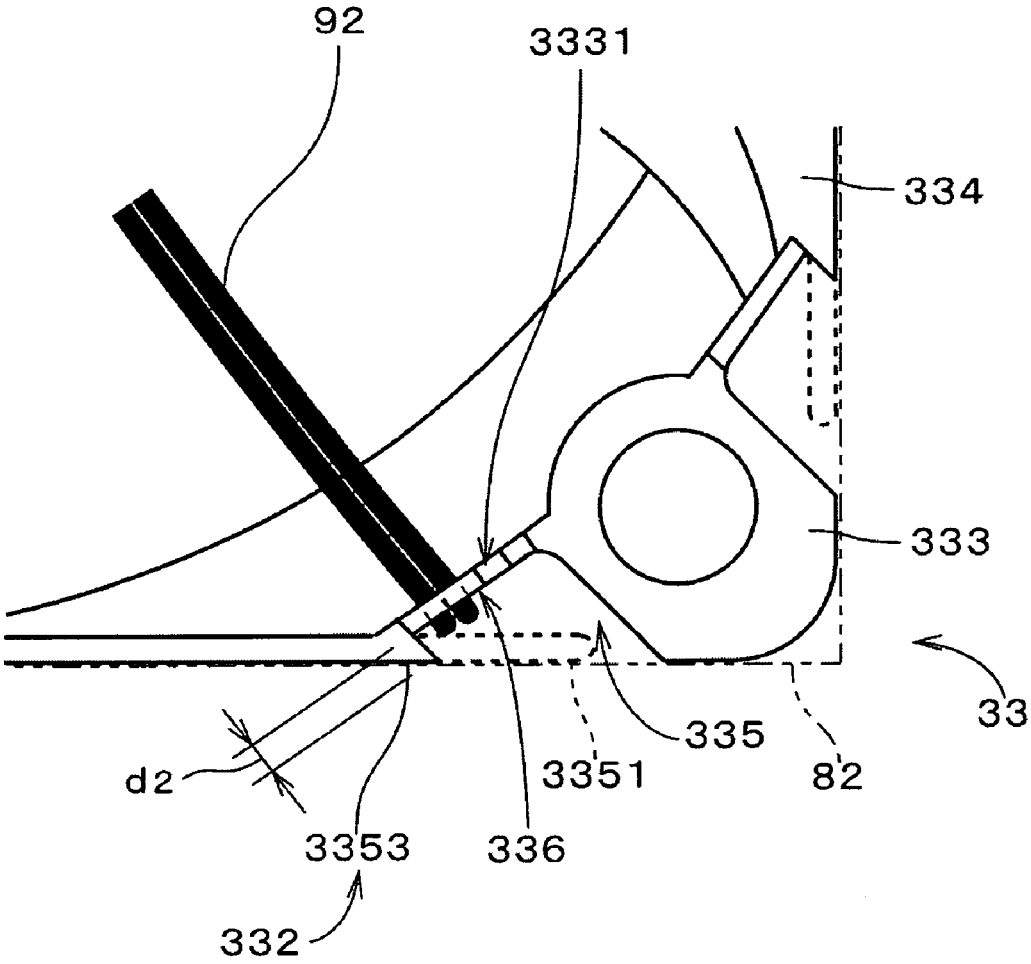
FIG. 7 is an enlarged view showing a guide portion and its vicinity in the first preferred embodiment of the present invention.

FIG. 7 is an enlarged view showing the guide portion 335 and its vicinity in the upper surface 334. In FIG. 7, the contour of the second housing 33 is indicated by a double-dotted chain line 82 and the guide portion hook 3351 is indicated by broken lines.

Similar to the first housing 23, the guide portion 335 extends to the upper and lower end surfaces of the second housing 33 through the guide flange portions 333. The second recess portion 3331 is positioned in the guide portion bottom surface 336 of the guide portion 335. In other words, the surface of the second housing 33 (namely, the guide portion bottom surface 336) is positioned radially inward of the contour 82 of the second housing 33 in the vicinity of the second recess portion 3331.

A protrusion portion 3353 protruding from the guide portion bottom surface 336 is provided in the end portion of the outer side surface 332 of the second housing 33 adjacent to the guide portion 335. In the guide portion 335, the minimum value of the distance between the guide portion bottom surface 336 and the contour 82 (namely, the distance d2 measured from the tip end of the protrusion portion 3353 to the guide portion bottom surface 336 in FIG. 7) is equal to or greater than the diameter of the first lead lines 91 and the second lead lines 92. Therefore, when conducting the first lead lines 91 and the second lead lines 92 within the guide portion 335, it is possible to prevent the first lead lines 91 and the second lead lines 92 from being pushed out beyond the contour of the second housing 33. The guide portion 335 may have a depth greater than the diameter of the second lead lines 92 only in the vicinity of the second recess portion 3331.

When assembling the axial flow fan unit 1 according to an example of a preferred embodiment of the present invention, the first lead lines 91 and the second lead lines 92 are first led out from the first housing 23 and the second housing 33. Then, the first lead lines 91 are conducted to the second gap 2335 through the first gap 2334 and are held on the right side of the second gap 2335 (see FIG. 4). Similarly, the second lead lines 92 are conducted to the second gap 3335 through the first gap 3334 and are held on the left side of the second gap 3335. Thereafter, the first housing 23 and the second housing 33 are coupled together so that the lower surface 234 and the upper surface 334 can overlap with each other. At this time, the fixed ends of the first hook 2332 and the second hook 2333 of the first housing 23 coincide in a circumferential position with the fixed ends of the first hook 3332 and the second hook 3333 of the second housing 33. On the other hand, the first hook 2332 and the second hook 3333 are different from each other in their circumferential length. For that reason, the first gap 2334 and the first gap 3334 are circumferentially spaced apart from each other. The first lead lines 91 and the second lead lines 92 are arranged side-by-side in the circumferential direction and are guided upwardly from the guide portion 235.

The gap size between the lower edges of the first hook 2332 and the second hook 2333 of the first recess portion 2331 and the upper edges of the first hook 3332 and the second hook 3333 of the second recess portion 3331 is smaller than the diameter of the first lead lines 91 and the second lead lines 92. Thus, the second lead lines 92 held in the second recess portion 3331 are prevented from moving toward the first recess portion 2331 after the axial flow fan unit 1 has been assembled.

Figure 8:
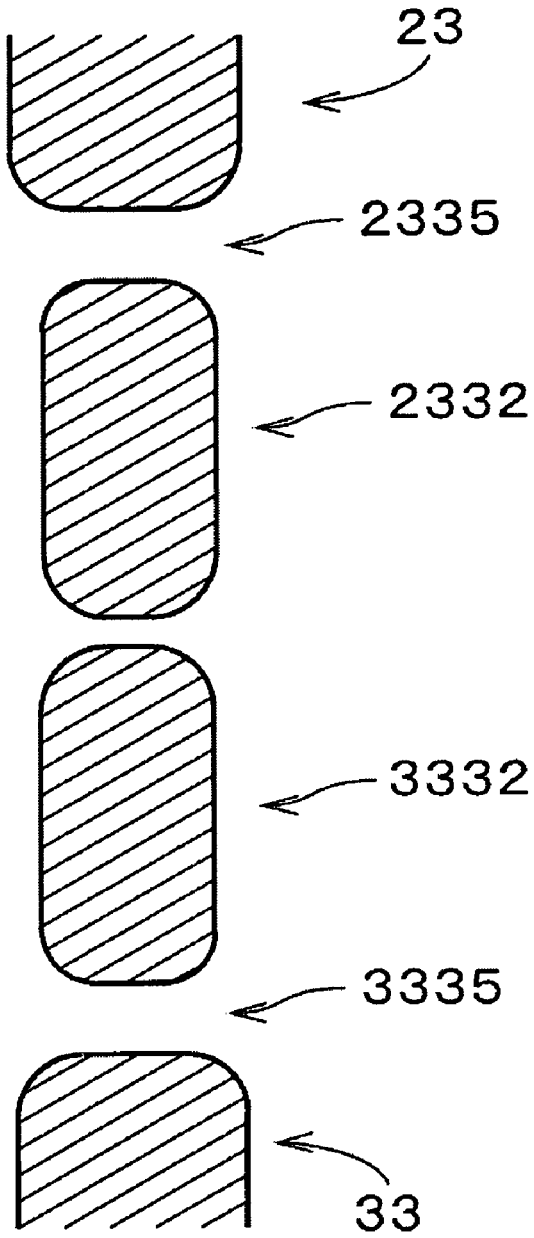
FIG. 8 is a sectional view showing a recess portion and its vicinity in the first preferred embodiment of the present invention.

FIG. 8 is a sectional view taken along line A-A in FIG. 4. As shown in FIG. 8, the inner and outer corners of the portion of the first housing 23 facing toward the second gap 2335, the inner and outer corners of the upper and lower edges of the first hook 2332, the inner and outer corners of the upper and lower edges of the first hook 3332, and the inner and outer corners of the portion of the second housing 33 facing toward the second gap 3335 are chamfered to have a substantially arc-shaped shape. Similarly, the inner and outer corners of the upper and lower edges of the second hooks 2333 and 3333 (see FIG. 4) of the first recess portion 2331 and the second recess portion 3331 have a chamfered shape. Moreover, the inner and outer corners of the tip edges of the first hooks 2332 and 3332 and the second hooks 2333 and 3333 have a chamfered shape.

As shown in FIG. 4, the upper and lower corners of the tip ends of the first hook 2332 and the second hook 2333 are chamfered to have a substantially arc-shaped shape when seen toward the center axis J1. In other words, the corner portion 2336 between the lower surface 234, i.e., the end surface, of the first housing 23 (the lower edges of the first hook 2332 and the second hook 2333) and the first gap 2334 and the corner portion 2337 between the first gap 2334 and the second gap 2335 are chamfered to have a substantially arc-shaped shape. This holds true for the second housing 33. The corner portion 3336 between the upper surface 334, i.e., the end surface, of the second housing 33 (the upper edges of the first hook 3332 and the second hook 3333) and the first gap 3334, and the corner portion 3337 between the first gap 3334 and the second gap 3335 are chamfered to have a substantially arc-shaped configuration.

By providing the corner portions 2336, 2337, 3336 and 3337 with a chamfered shape, the first lead lines 91 and the second lead lines 92 are prevented from being damaged when they pass through the first recess portion 2331 and the second recess portion 3331. Furthermore, since the corners of the housings and the hooks have a chamfered shape in the vertical cross-section as shown in FIG. 8, the first lead lines 91 and the second lead lines 92 are prevented from being damaged when they are inserted into the first recess portion 2331 and the second recess portion 3331 or after they have been inserted into the recess portions 2331 and 3331. The chamfered shape mentioned above is not particularly limited but may be, e.g., a so-called C-shaped bevel shape formed by cutting the corner portions at 45 degrees.

As described hereinabove, since the first gap 2334 of the first recess portion 2331 and the first gap 3334 of the second recess portion 3331 are staggered with each other as shown in FIG. 4, it is possible to prevent the second lead lines 92 from being moved into the first recess portion 2331 and becoming loose (more precisely, the second lead lines 92 are kept from becoming loose to a greater extent because they can move up to the first gap 2335). As shown in FIGS. 3 and 5, since the guide portion 235 is positioned radially inward of the contour of the first housing 23, it is possible to prevent the first lead lines 91 and the second lead lines 92 from being pushed out beyond the contour of the first housing 23 or to reduce the amount the first lead lines 91 and the second lead lines 92 are pushed out.

Figure 9:
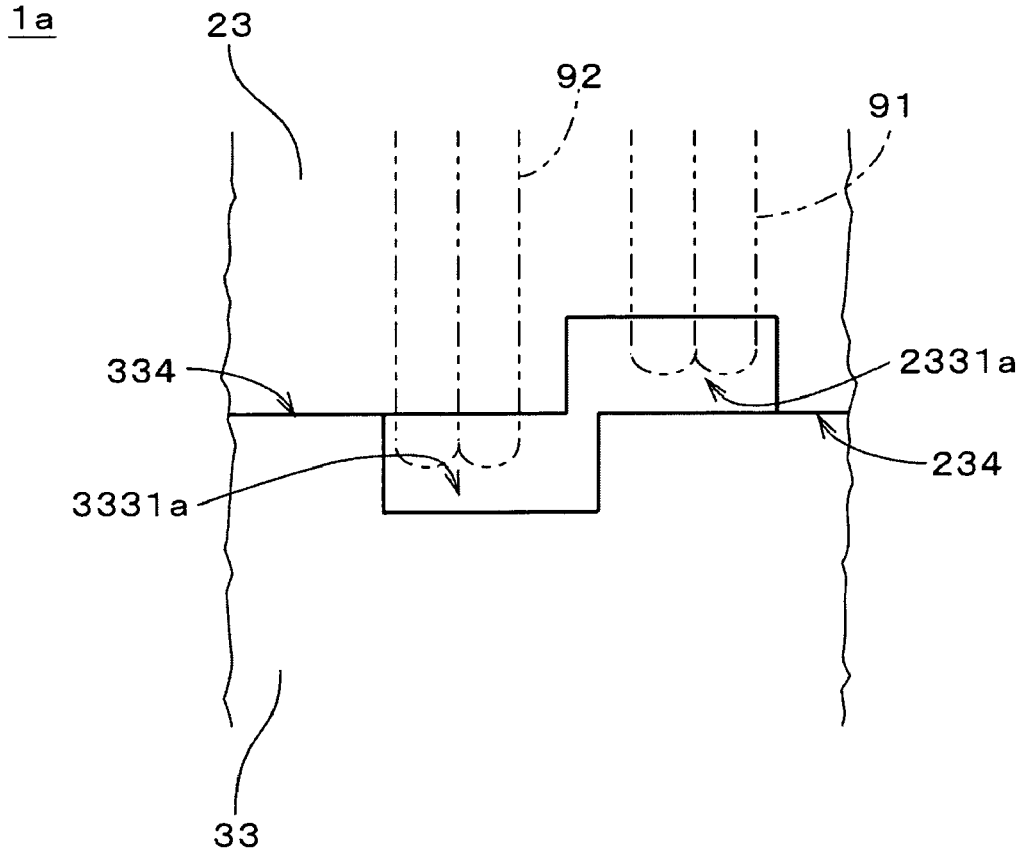
FIG. 9 is an enlarged view showing a recess portion and its vicinity in a second preferred embodiment of the present invention.

FIG. 9 is an enlarged view showing a first recess portion 2331*a* of the first housing 23, a second recess portion 3331*a* of the second housing 33 and their vicinity in a serially arranged axial flow fan unit 1*a* in accordance with a second preferred embodiment of the present invention. In FIG. 9, the first lead lines 91 and the second lead lines 92 are indicated by a double-dotted chain line. The axial flow fan unit 1*a* of the second preferred embodiment is the same as the axial flow fan unit 1 of the first preferred embodiment except for the difference in the shape of the first and second recess portions.

The first recess portion 2331*a* extends upwardly from the lower surface 234 of the first housing 23 and continuously extends from the inner side of the first housing 23 to the outer side thereof. The first recess portion 2331*a* has a depth greater than the diameter of the first lead lines 91 and a width greater than the total width of the first lead lines 91 arranged side-by-side. The second recess portion 3331*a* extends downwardly from the upper surface 334 of the second housing 33 and continuously extends from the inner side of the second housing 33 to the outer side thereof. The second recess portion 3331*a* has a depth slightly greater than the diameter of the second lead lines 92 and a width greater than the total width of the first lead lines 91 arranged side-by-side. The first lead lines 91 and the second lead lines 92 are led out from the first recess portion 2331*a* and the second recess portion 3331*a*, respectively, and are conducted upwardly by the same guide portion as the guide portion 235 shown in FIG. 1.

When assembling the axial flow fan unit 1*a* of the second preferred embodiment, the first lead lines 91 and the second lead lines 92 are allowed to pass through the first recess portion 2331*a* and the second recess portion 3331*a*. The first housing 23 and the second housing 33 are placed one upon another in the axial direction. At this time, the first recess portion 2331*a* and the second recess portion 3331*a* are partially overlapped and staggered in the circumferential direction. The clearance defined by the overlapping region of the first recess portion 2331*a* and the second recess portion 3331*a* (namely, the circumferential overlapping width of the first recess portion 2331*a* and the second recess portion 3331*a*) is smaller than the diameter of either the first lead lines 91 or the second lead lines 92. Thus, the second lead lines 92 are prevented from coming out of alignment and moving into the first recess portion 2331*a*, which would otherwise be caused by external shocks or the like. As a result, in the axial flow fan unit 1*a*, it is possible to prevent the second lead lines 92 from being moved into the first recess portion 2331*a* and becoming loose. In the present preferred embodiment, the second recess portion 3331*a* has the same shape and size as the first recess portion 2331*a*. However, the shape or size of the first recess portion 2331*a* and the second recess portion 3331*a* is not particularly limited but may be different from each other, insofar as the circumferential overlapping width of the first recess portion 2331*a* and the second recess portion 3331*a* is smaller than the diameter of either the first lead lines 91 or the second lead lines 92.

Figure 10:
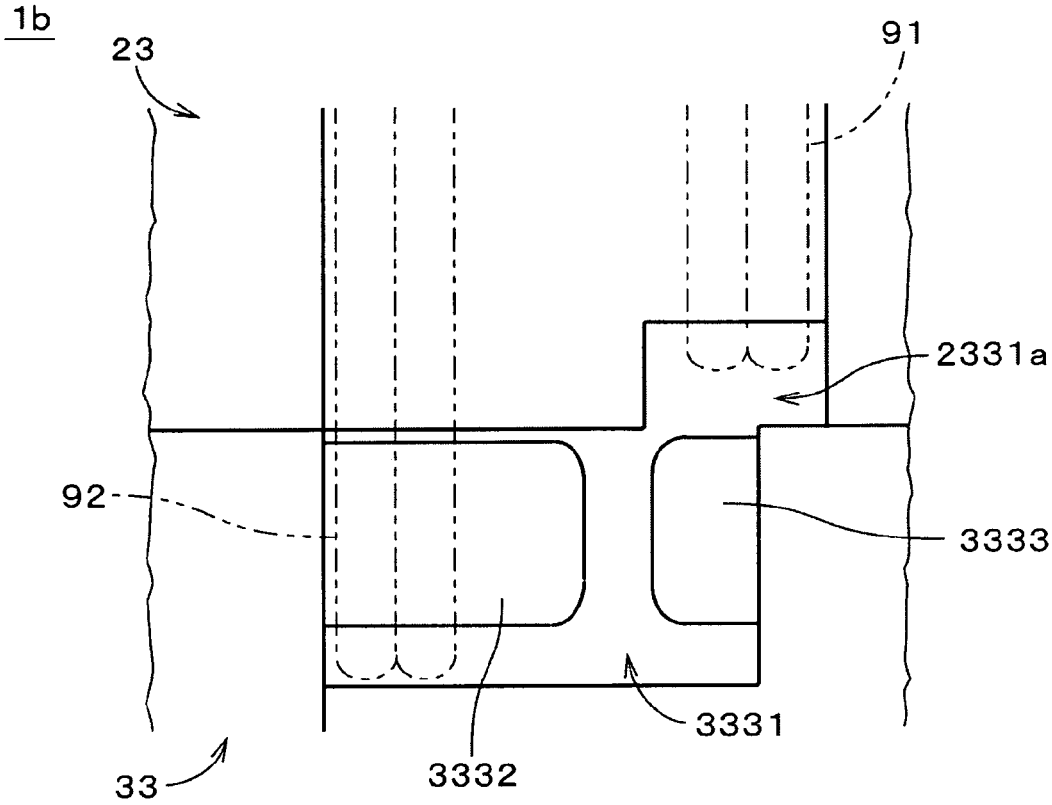
FIG. 10 is an enlarged view showing a recess portion and its vicinity in another example of a third preferred embodiment of the present invention.

Next, description will be made with respect to a third preferred embodiment of the present invention. FIG. 10 is an enlarged view showing the first recess portion 2331*a* of the first housing 23, the second recess portion 3331 of the second housing 33 and their vicinity in a serially arranged axial flow fan unit 1*b* in accordance with the third preferred embodiment of the present invention.

It is not necessary to provide the first hooks 2332 and 3332 and the second hooks 2333 and 3333 in both the first housing 23 and the second housing 33. The first hooks 2332 and 3332 and the second hooks 2333 and 3333 may be provided in at least one of the first recess portion 2331 and the second recess portion 3331. In the first housing 23 and the second housing 33, there may be provided only the hooks for holding the first lead lines 91 and the second lead lines 92 along the guiding direction of the first lead lines 91 and the second lead lines 92.

Referring to FIG. 10, a first recess portion 2331*a* is provided in the first housing 23 and a second recess portion 3331 is provided in the second housing 33. In order to guide the first and the second lead lines 91 and 92 in the upward direction (namely, toward the first housing 23), a first hook 3332 and a second hook 3333 are provided only in the second housing 33 on the opposite side from the first housing 23. This makes it easy to hold the second lead lines 92 when assembling the axial flow fan unit 1*b*. Thus, the second lead lines 92 are prevented from being moved into the first recess portion 2331 and becoming loose. In case where the first lead lines 91 and the second lead lines 92 are conducted in the downward direction (namely, toward the second housing 33), the first hook 2332 and the second hook 2333 may be provided only in the second housing 33.

Figure 11:
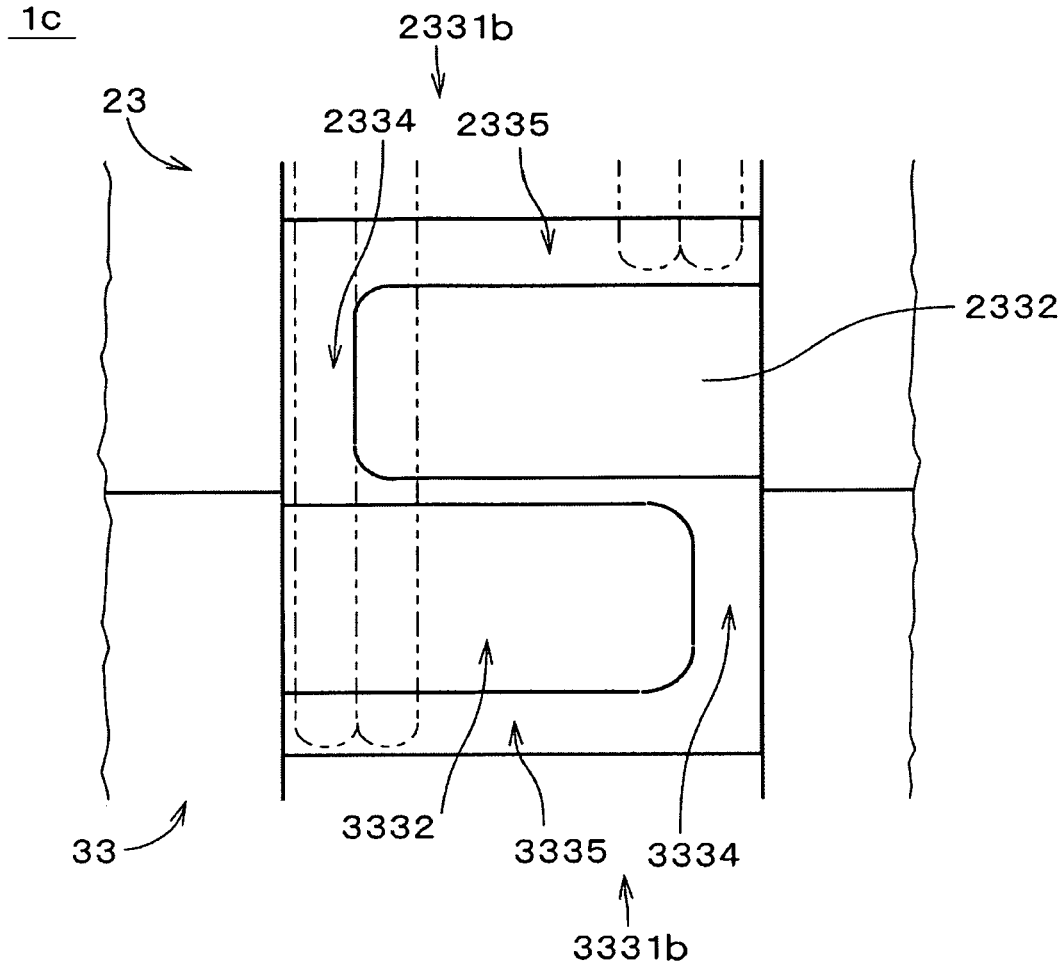
FIG. 11 is an enlarged view showing a recess portion and its vicinity in a fourth preferred embodiment of the present invention.

Next, description will be made with respect to a fourth preferred embodiment of the present invention. FIG. 11 is an enlarged view showing the first recess portion 2331*b*, the second recess portion 3331*b* and their vicinity in a serially arranged axial flow fan unit 1*c* in accordance with the fourth preferred embodiment of the present invention.

As shown in FIG. 11 and unlike the first recess portion 2331 shown in FIG. 4, the first hook 2332 alone is provided in the first recess portion 2331*b* with the second hook 2333 omitted. In other words, the first recess portion 2331*b* has a generally L-shaped shape between the tip and upper edges of the first hook 2332 and the portion of the first housing 23 opposite to the edges. Similarly, the first hook 3332 alone is provided in the second recess portion 3331*b* of the second housing 33 with the second hook 3333 omitted. Just like the first recess portion 2331*b*, the second recess portion 3331*b* has a generally L-shaped shape. In this case, each of the first recess portion 2331*b* and the second recess portion 3331*b* has a shape obtained by combining the first gap 2334 or 3334 extending substantially parallel to the center axis J1 from the end surfaces of the first housing 23 and the second housing 33 and the second gap 2335 or 3335 circumferentially extending from the end of the first gap 2334 or 3334. The first lead lines 91 and the second lead lines 92 are conducted outward through the second gaps 2335 and the 3335 thereby preventing removal of the lead lines which would otherwise occur in the process of assembling the fan.

Figure 12:
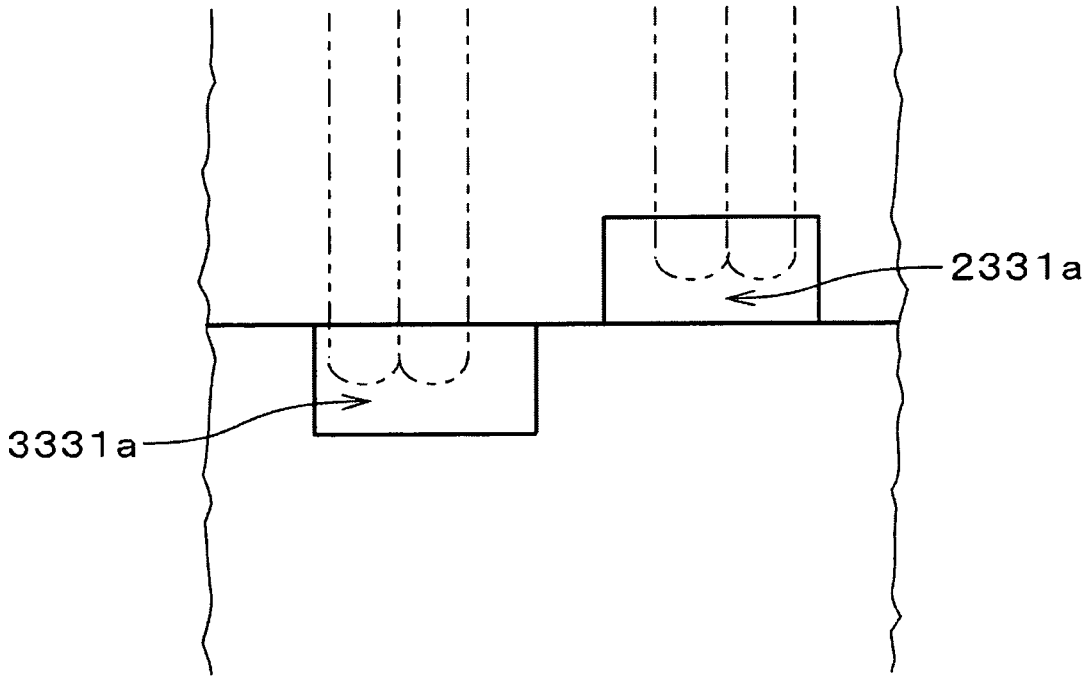
FIG. 12 is an enlarged view showing a recess portion and its vicinity in another example.

It is not necessary to provide the guide portions 235 and 335 in both the first housing 23 and the second housing 33. The guide portions 235 and 335 may be provided only in one of the first housing 23 and the second housing 33. The shape of the first recess portions 2331*a* and 3331*a* is not limited to the rectangular or substantially rectangular shape but may be other shapes (e.g., a semicircular or substantially semicircular shape or a polygonal or substantially polygonal shape). As shown in FIG. 12, the first recess portion 2331*a* and the second recess portion 3331*a* may be arranged in completely spaced-apart positions without circumferentially overlapping each other. That is, the first recess portion 2331*a* may be opposite to the end surface of the second housing 33, with the second recess portion 3331*a* opposite to the end surface of the first housing 23.

The contour of the first housing 23 and the second housing 33 is not particularly limited to the substantially quadrangular prism shape. In this regard, the contour of the first housing 23 and the second housing 33 may have a cylindrical columnar shape or other columnar shapes such as a polygonal prism shape. Further, the first recess portion 2331 may be slightly deviated relative to (namely, close to) the second recess portion 3331 in the circumferential direction about the center axis J1, or partially overlapped with the second recess portion 3331 in the circumferential direction wherein an overlapping width is equal to or smaller than the width of the lead lines. It is also preferred that the guide portions 235 and 335 are provided outward of the first recess portion 2331 and the second recess portion 3331 but inward of the contour in the first housing 23 or the second housing 33.

Since the distance between the surface of the first housing 23 and the second housing 33 and the contour thereof is greater than the diameter of the first lead lines 91 and the second lead lines 92 in the vicinity of the first recess portion 2331 and the second recess portion 3331, the first lead lines 91 and the second lead lines 92 are prevented from being pushed out beyond the contour of the first housing 23 and the second housing 33. In this case, it is preferred that the guide portions 235 and 335 have restraint portions (guide portion hooks) arranged to prevent outward movement of the first lead lines 91 and the second lead lines 92 in the vicinity of the first recess portion 2331 and the second recess portion 3331. In addition, it is preferred that both the first housing 23 and the second housing 33 have the guide portions 235 and 335.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A serially arranged axial flow fan unit comprising:

a first axial flow fan including:

a first motor;

a plurality of first lead lines connected to the first motor;

a first impeller rotatable about a center axis by the first motor;

a first housing arranged to enclose the first motor and the first impeller, the first housing having a first recess extending from an inside to an outside of the first housing, the first recess being arranged in a first guide portion; and a plurality of first flange portions, the plurality of first flange portions including a first guide flange portion, the first recess being arranged adjacent to the first guide flange portion; and a second axial flow fan including:

a second motor;

a plurality of second lead lines connected to the second motor;

a second impeller rotatable by the second motor;

a second housing arranged to enclose the second motor and the second impeller, the second housing opposing the first housing and having a second recess extending from an inside to an outside of the second housing, the second recess being arranged in a second guide portion; and a plurality of second flange portions, the plurality of second flange portions including a second guide flange portion, the second recess being arranged adjacent to the second guide flange portion; wherein the first lead lines extend from the first housing through the first recess and the second lead lines extend from the second housing through the second recess;

the first recess is spaced apart from or partially overlapped with the second recess along a circumferential direction;

the plurality of first lead lines and the plurality of second lead lines are arranged directly adjacent to one another such that the plurality of first lead lines are drawn out of the axial flow fan unit through the first guide portion and the plurality of second lead lines are drawn out of the axial flow fan unit through the first guide portion and the second guide portion; and the first guide flange portion and the second guide flange portion being circumferentially aligned with one another, both the first guide portion and the second guide portion being arranged on a same circumferential side of the first guide flange portion and the second guide flange portion.

2. The axial flow fan unit of claim 1, wherein the first recess at least partially overlaps with the second recess in the circumferential direction.

3. The axial flow fan unit of claim 2, wherein the first and the second recess overlap each other such that a circumferential overlapping width is smaller than a diameter of the first or the second lead lines.

4. The axial flow fan unit of claim 1, wherein the first and the second lead lines are substantially guided in an axial direction on the first or the second housing.

5. The axial flow fan unit of claim 1, wherein each of the first and the second housings has a substantially quadrangular prism-shaped contour, the first recess is provided in a corner portion of the first housing, the second recess is provided in a corner portion of the second housing overlapping with the corner portion of the first housing.

6. The axial flow fan unit of claim 1, wherein the first and the second housings each include a surface arranged near the first and the second recess, respectively, and positioned radially inward of an outer contour of the first and the second housings.

7. The axial flow fan unit of claim 6, wherein a distance between the surface of each of the first and second housings and the outer contour of the first and second housings in the vicinity of the first and second recess is greater than a diameter of the first or the second lead lines.

8. The axial flow fan unit of claim 6, wherein the first guide portion includes a guide portion hook extending at a right angle with respect to the center axis.

9. The axial flow fan unit of claim 6, wherein the first guide portion includes an end portion hook adjacent to an axial end of the first or the second housing.

10. The axial flow fan unit of claim 1, wherein at least one of the first and the second recesses has a shape defined by a first gap extending substantially parallel to the center axis from an end surface of the first or the second housing and a second gap circumferentially extending about the center axis from the first gap.

11. The axial flow fan unit of claim 10, wherein the first or the second housing includes a chamfered corner between the end surface thereof and the first gap, and a chamfered corner arranged between the first gap and the second gap.

12. The axial flow fan unit of claim 1, wherein the first and the second impeller rotate in opposite directions.

13. The axial flow fan unit of claim 1, wherein the first and the second recess have a substantially identical shape and size.

14. The axial flow fan unit of claim 1, wherein the first recess has a width greater than a total width of the first lead lines arranged side-by-side, and the second recess has a width greater than a total width of the second lead lines arranged side-by-side.

15. The axial flow fan unit of claim 1, wherein the first recess has a depth greater than the diameter of the first lead lines, and the second recess has a depth greater than the diameter of the second lead lines.

16. The axial flow fan unit of claim 1, wherein the first recess is opposite to an end portion of the second housing, and the second recess is opposite to an end portion of the first housing.

* * * * *